US008746149B2

(12) United States Patent
Elhard

(10) Patent No.: US 8,746,149 B2
(45) Date of Patent: Jun. 10, 2014

(54) TURN WHEEL AND METHOD FOR SUPPORTING A CURVED PORTION OF A LOAD-TRANSPORTING CABLE

(76) Inventor: Thomas Austin Elhard, Woodbridge, CA (US)

( * ) Notice: Subject to any disclaimer, the term of this patent is extended or adjusted under 35 U.S.C. 154(b) by 0 days.

(21) Appl. No.: 13/507,439

(22) Filed: Jun. 29, 2012

(65) Prior Publication Data

US 2013/0112103 A1 May 9, 2013

Related U.S. Application Data

(60) Provisional application No. 61/628,917, filed on Nov. 8, 2011.

(51) Int. Cl.
*B61B 7/06* (2006.01)

(52) U.S. Cl.
USPC ..... 104/191; 104/182; 104/189

(58) Field of Classification Search
USPC ..... 104/93, 112, 113, 115, 125, 173.1, 180, 104/182, 189, 191
See application file for complete search history.

(56) References Cited

U.S. PATENT DOCUMENTS

| | | | | | |
|---|---|---|---|---|---|
| 773,901 | A * | 11/1904 | Streuli | ..... | 104/180 |
| 861,818 | A * | 7/1907 | Drake | ..... | 104/180 |
| 885,455 | A * | 4/1908 | Drake | ..... | 104/191 |
| 905,337 | A * | 12/1908 | Lind | ..... | 104/180 |
| 977,988 | A * | 12/1910 | Wilson | ..... | 104/189 |
| 3,339,497 | A * | 9/1967 | Bancel | ..... | 104/197 |
| 3,557,706 | A * | 1/1971 | Maurer | ..... | 104/191 |
| 3,804,373 | A * | 4/1974 | Ross | ..... | 254/398 |
| 4,265,179 | A * | 5/1981 | Tupper et al. | ..... | 104/182 |
| 6,360,669 | B1 * | 3/2002 | Albrich | ..... | 104/93 |
| 2009/0151594 | A1 * | 6/2009 | Dur et al. | ..... | 104/112 |

FOREIGN PATENT DOCUMENTS

FR 2684631 A1 * 6/1993 ..... B61B 12/02

* cited by examiner

*Primary Examiner* — Zachary Kuhfuss
(74) *Attorney, Agent, or Firm* — Gene W Arant

(57) ABSTRACT

A turn wheel for supporting a tensioned stationary cable through a curved path in a horizontal plane, and for allowing a load advancing along the cable to engage the turn wheel for driving the wheel in rotation relative to the cable, while at the same time the turn wheel continues to support both the cable and the load.

4 Claims, 6 Drawing Sheets

34
C
35
12a
34
20
12b
36
35
22
34
12c
34

TURN WHEEL AND METHOD FOR SUPPORTING A CURVED PORTION OF A LOAD-TRANSPORTING CABLE

CROSS-REFERENCE TO RELATED APPLICATION

This application claims the benefit of my provisional application Ser. No. 61/628,917 filed Nov. 8, 2011

BACKGROUND OF THE INVENTION

There are many different applications where a load-transporting cable is used. Well over a hundred years ago such cables were used in mining operations to remove buckets of ore from a mine. In recent decades the sporting world has made extensive use of such apparatus, particularly on ski slopes and the like. In that environment the name ZIPLINE has become a popular shorthand name for the product. The load is often a single person who is to be transported.

A problem encountered in early mining days was how best to operate the cable through a curved path. That problem still faces today's sporting world. One solution has been to place a wheel in a horizontal plane at the location where the path of the cable needs to curve, and at the elevation at which the cable needs to be supported.. The wheel is then mounted on a vertical shaft and rotatable about a vertical axis. The cable must then be supported from the periphery of the wheel as the cable—and/or its load—negotiates along a curved path at the perimeter of the wheel. Various mechanisms have been used to support the loaded cable from the wheel.

In some situations the cable is pulled longitudinally, and carries a load attached at a fixed point along the cable length. The cable and its fixed load then travel together around a curved path defined by the ends of the wheel spokes. In other situations the cable itself is fixed and does not move longitudinally, but still requires vertical support at the spoke ends. A carriage or the like rides on the cable, and a load secured under the carriage moves along with the carriage lengthwise of the cable.

PRIOR ART

Anderson patent No. 246,361 issued in 1881 shows a horizontal wheel with spokes having pulleys on their ends to provide vertical support for the moving cable. Each of the spokes, as it is about to be encountered by the moving load, is selectively retracted in a direction radially of the wheel until the load has moved past it.

Drake patent No. 885,455 issued in 1908 shows a rotatable wheel 7 mounted in the horizontal plane, and a stationary cable 9 supported vertically by horizontal pulleys on the ends of the wheel spokes. A carriage traveling along the fixed cable has a depending load, driven by a powered rope 5 which parallels the cable. The wheel spokes 6 do not themselves retract, but adjustable member 12 at the outer end of each wheel spoke selectively retracts when engaged by the passing carriage. The carriage then travels a straight line between two spokes on which member 12 is unretracted.

Maurer patent No. 3,557,706 issued in 1971 is entitled Deviation Device of a Towing Ropeway. It shows a wheel 5 with a wheel rim 9 for supporting a rope 1 which engages the end of wheel spokes along an arcuate path. Guiding elements 6 are retractable radially from their position on the rope-guiding periphery of wheel 5, to avoid obstructing the load as it moves along a path defined by the periphery of the wheel.

Rooklyn patent No. 3,557,930 issued in 1971 shows an overhead conveyor system with dual tracks and a unique trolley (or carriage) design for supporting a suspended load. A horizontally disposed toothed wheel 126 supports a curved portion of the dual tracks and allows the trolley 180 to pass through that curved track portion. The toothed wheel has circumferentially spaced notches around its peripheral rim, and a moving trolley will occupy one of those notches as it rounds the curve.

Ross patent 3,804,373 issued in 1974 is entitled Deflector for Cable Transport. A cable 7 passes around the periphery of a horizontal wheel 4 . The periphery of wheel 4 has a large number of cable guides 6. Each guide is separately rotatable. As the cable moves, outriggers 8 which support the load also move, forcing one of the guides 6 out of the way so that the outrigger can securely seat itself between two adjacent guides 6.

Bancel patent No. 3,865,044 issued in 1975 is entitled Guide Device for the Haulage Attachments of a Ski-lift. The cable passes over pulleys which are vertically aligned and rotate on horizontal axes. The purpose is to assure that the cable attachments always pass over the pulleys in a satisfactory manner.

Albrich patent No. 6,360,669 issued in 2002 relates to the moving of persons using carriages 4 driven by cable 5 along rail 3. See FIG. 1. At each location 3*b* where there is a horizontal curve in the path of rail 3 there is a supporting pylon 7. Each pylon has horizontally (radially) projecting struts 71, which carry pulley wheels (guide rollers) 73 that engage and ride within the inner surface of rail 3. The struts 71 are articulated on the supporting pylons, such that they can be pivoted about vertical axes (so as to move circumferentially of the curve) to maintain their support of the inner side of the rail 3 as a carriage 4 moves past.

Dur patent publication U.S. 2009/0151594 was published Jun. 18, 2009. It relates to a load carrying cable system moving along a route having a slightly curved portion (FIGS. 1 and 2). The cable loop has two strands, an out going strand 1A and a return strand 1B. A deflector drum 6 of conical configuration is driven by the cable incoming strand 1B to rotate continuously on a vertical axis (FIGS. 1, 2, and 3). The drum 6 is of conical configuration, being smaller on its lower end, and the incoming cable strand 1B appears to slide up and down on that conical surface (FIG. 3). The drum 6 also has circumferentially distributed peripheral recesses 61 to accommodate the load supporting bars 21 as they move past. It is the conical shape of the deflector drum 6 that allows or guides load bars 21 to enter recesses 61 as they move along a curved path past the drum.

SUMMARY OF THE PRESENT INVENTION

According to the present invention I provide a turn wheel for supporting a transport cable in a curved path in a generally horizontal plane, whether the cable is stationary or is independently pulled longitudinally along that curved path. My turn wheel is generally horizontal. It is driven in rotation about a vertical axis, not by the cable, but by a load that is passing along the curved path of the cable in that plane.

In the preferred application of my invention the load transporting cable is completely stationary, so only the load moves along the curved path for driving the wheel in rotation. In other applications of my invention the load is secured and supported at a fixed point along the length of the cable, and the cable is independently pulled in a longitudinal direction, carrying the load with it to drive the wheel in rotation.

My wheel has a generally cylindrical housing or frame supported on a vertical axis of rotation, and a circumferentially spaced set of spokes in a common horizontal plane extending radially from the housing or frame. The moving load engages a single one of the spokes for driving the wheel in rotation as the load moves along the curved path of the cable.

In my turn wheel the upper surface of each of the spokes slopes downwardly toward its radially outward end. When my turn wheel is supporting the cable, the cable is wrapped at least partially around the generally cylindrical frame, and in contact with it. The radius of that cylindrical housing defines the curvature of the cable. The curved portion of the cable then also rests upon the upper surface of at least one of the spokes. If the cable pathway is sharply curved the cable may rest upon at least three or more of the spokes.

The exact position of the cable relative to the wheel is determined by a number of factors including the degree of curvature of the curved path, the amount of longitudinal tension in the cable, and the magnitude of the vertical load on the cable. Although in theory the cable might be wound around the wheel without even engaging the cylindrical housing, and resting only upon the surfaces of several spokes, that would not be mechanically stable. The reason is that variations or uncertainties in the amount of longitudinal tension in the cable, and in the magnitude of the vertical load, would make it too difficult to predict or control the cable position.

When the wheel is driven in rotation relative to the cable, the sloped surfaces of the outer ends of the spokes cooperate with the cable to provide a camming action. As the wheel rotates, the points of contact between the cable and the various spokes will move radially along the spokes, while still preserving the vertical support of the cable.

In the preferred form of my turn wheel the cylindrical housing or drum has a radius that is much larger than the length of the spokes. In the preferred method of use according to my invention the cable is wrapped at least partially around, and in contact with, the cylindrical housing or drum. It is then the radius of the housing that determines the degree of curvature of the curved path of the cable.

The unique design of my wheel permits a load suspended from the cable to pass through a curved path without obstruction by the turn wheel. My invention assures that the cable and its load will continue to be vertically supported from the wheel spokes in a continuous and effective manner as the load passes along that curved path.

In the preferred form of my invention each radial spoke is accompanied by a safety arm that extends above the spoke in a generally parallel relation. The spoke and its safety arm are joined at their base to form an open jaw into which the cable selectively moves in or out as the turn wheel rotates.

When my invention is used with a stationary cable having fixed supports at its ends, the fixed cable has a substantial amount of longitudinal stress. Typically there is a carriage or trolley that moves longitudinally along the cable and from which the load is suspended. It is then the movement of the load along the curved cable path that drives my turn wheel in rotation.

The diameter of my wheel, and the number and length of the spokes, and the spacing between them, are selected such that a trolley or carriage traveling along the curved cable path will enter a space between two of the spokes and will unambiguously engage the side of only a single spoke for driving my turn wheel in rotation.

The cable is subject to a vertically downward force from its own weight and also from a trolley or carriage and an accompanying load. When the cable lies in a curved path supported by the turn wheel, the tension in the cable creates a force in the cable in a horizontal direction radially inward toward the center of the wheel. The vertical weight of the loaded cable is supported on the ends of one or more spokes. It is the combination of a radial counterforce from the housing and a vertical counterforce from the spoke inner ends that establishes a stable position of the cable.

In a sporting environment where the load transporting cable is sometimes referred to as a ZIPLINE, the load may be a person hanging onto a moving trolley. As the trolley approaches the curved portion of the cable it passes one or more of the wheel spokes before engaging a single spoke to drive the wheel in rotation. If the person who is hanging from the trolley would be speeding unrestrained down a steep hillside, it is advisable to provide compatible parts or surfaces on both the trolley and the spoke to ensure that the driving engagement of a forward surface of the trolley with a side surface of the spoke will be mechanically reliable and safe.

When a stationary cable is employed, the movement of the load along the static cable driving the wheel in rotation necessarily creates a sliding movement of the cable across the upper surface of each spoke then supporting the cable. For that stationary cable application I prefer to provide suitable bearings associated with each spoke in order to facilitate the sliding movements of the wheel spokes relative to the cable.

One preferred bearing action is provided by an elongated cylinder arranged essentially parallel to the upper surface of the spoke, and supported by bearings at its two ends and secured to respective ends of the spoke. For that stationary cable application I also prefer to provide bearing means in the form of a pulley wheel in the bottom of the open jaw defined by the spoke and its accompanying safety arm. The pulley wheel is supported on an axis of rotation that is perpendicular to the jaw opening.

The main reason for the invention is to provide a more exciting zipline ride. It will also provide safer access for disabled and elderly people by not having to change from cable to cable many feet above ground. It will also reduce the number of platforms that need to be attached to trees. It will also allow a course to be built with different segments between different turn wheels that can be traversed at different speeds.

BRIEF DESCRIPTION OF DRAWINGS

FIG. 1) is a perspective view of a stationary ZIP line extending down a hillside slope. There are three bend portions of the cable, each of which is supported by one of my new multi-spoke turn wheels. Each turn wheel is supported above ground on a separate stand. Two men are in the process of coming down the hill, each being supported from the ZIP line cable by his own separate trolley. The force of gravity drives each of the trolleys down the cable, and also allows the trolleys when engaging one of the wheels to drive the wheel in rotation as the trolley passes through it. The three turn wheels make it possible for the sportsters (the two men) to navigate around a large tree that would otherwise block their path.

FIG. 7A shows engagement of a trolley with a push bar, and FIG. 7B shows the sliding movement of the cable radially of the spoke as the wheel rotates.

DETAILED DESCRIPTION

Figure 1:
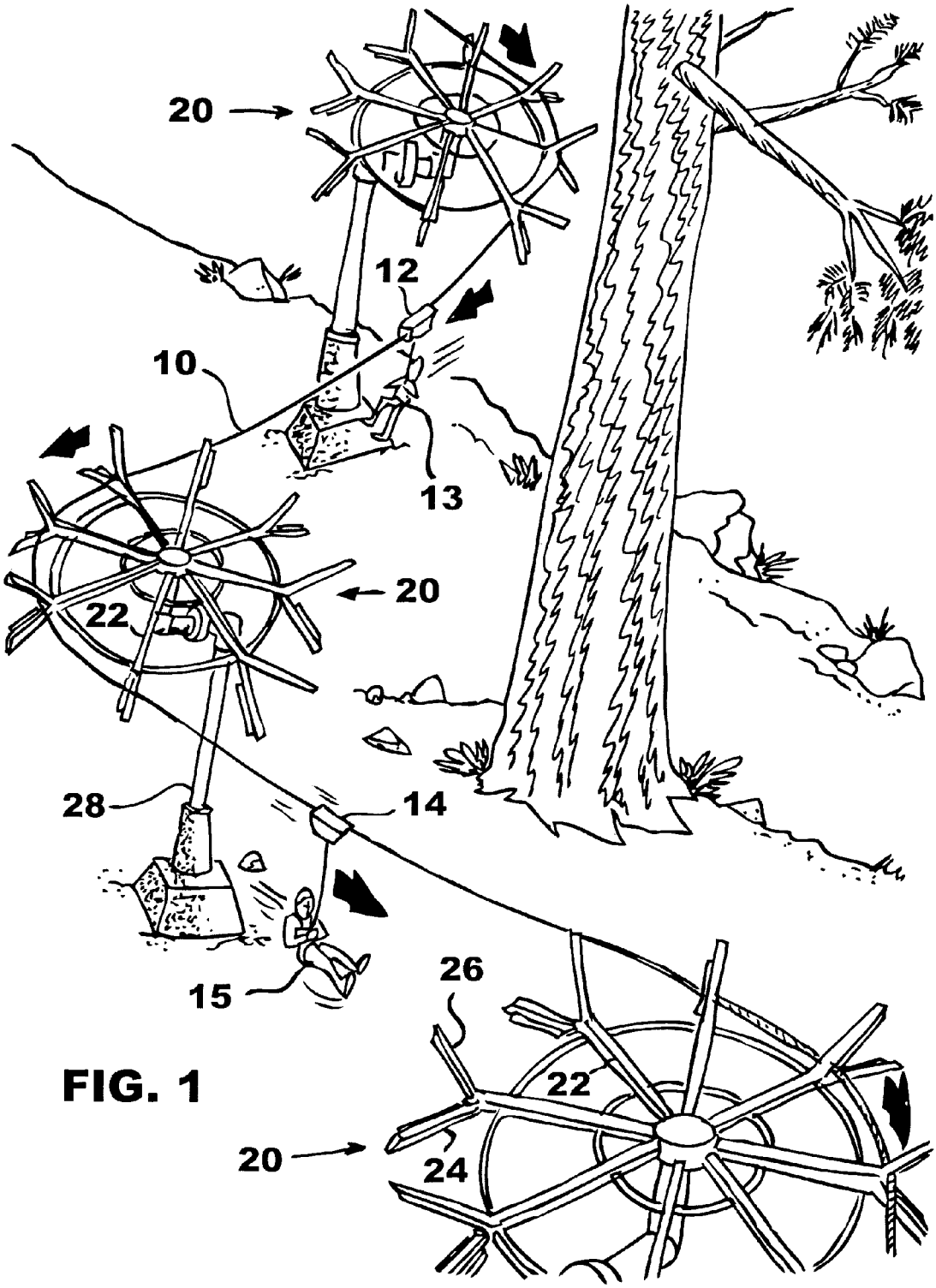
FIG. 1 (orig.

Referring now to FIG. 1, a stationary cable or ZIP line 10 extends down a hillside slope. There are three generally horizontal bends in the cable 10, each supported by a corresponding turn wheel 20. Each turn wheel 20 has a set of radially extending spokes 22 with bifurcated outer ends. The lower portion of each spoke arm is designated 24 and the upper portion as 26. Each turn wheel also has its own support stand 28. Two trolleys 12 and 14 running down the stationary line carry two sportsters 13 and 15 who are riding down the hill. The cable 10 is received by open jaws formed at Thomas Austin Elhard Turn Wheel Page Eleven each wheel location by the spoke arm extensions 24 and 26. As each trolley arrives at a turn wheel location it is driven along the cable by the force of gravity, enters a space between two adjacent spokes of a turn wheel, and thus drives the turn wheel in rotation. The trolley carrying its passenger then moves on through the turn wheel location.

Figure 3:
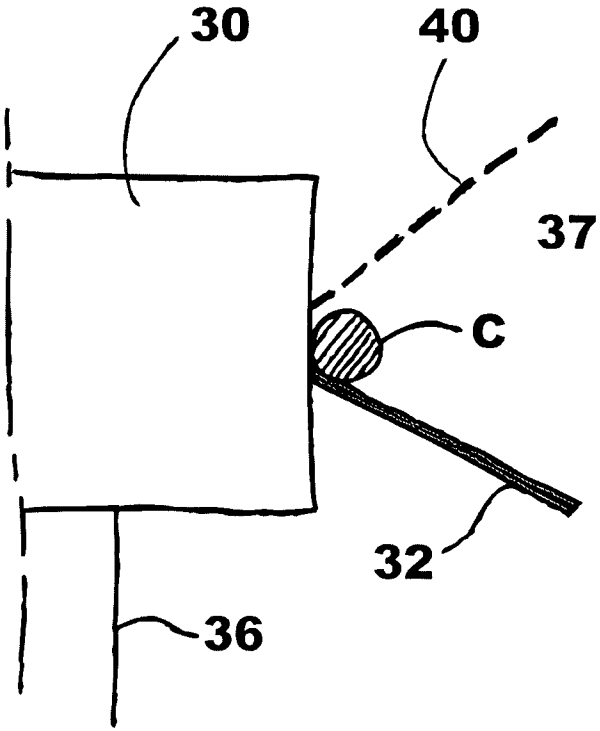
FIG. 3 is a vertical cross-sectional view taken on the line 3-3 of FIG. 2. It shows a spoke with its inner end attached to the cylindrical housing, the spoke then extending radially outwardly with the upper surface of its outer end surface sloping downwardly. The cable is supported in a cradled relation by the housing or drum and the inner end of the spoke. A dotted line shows location of the associated safety rod which is attached to the cylinder wall above the spoke arm and cable.
Figure 2:
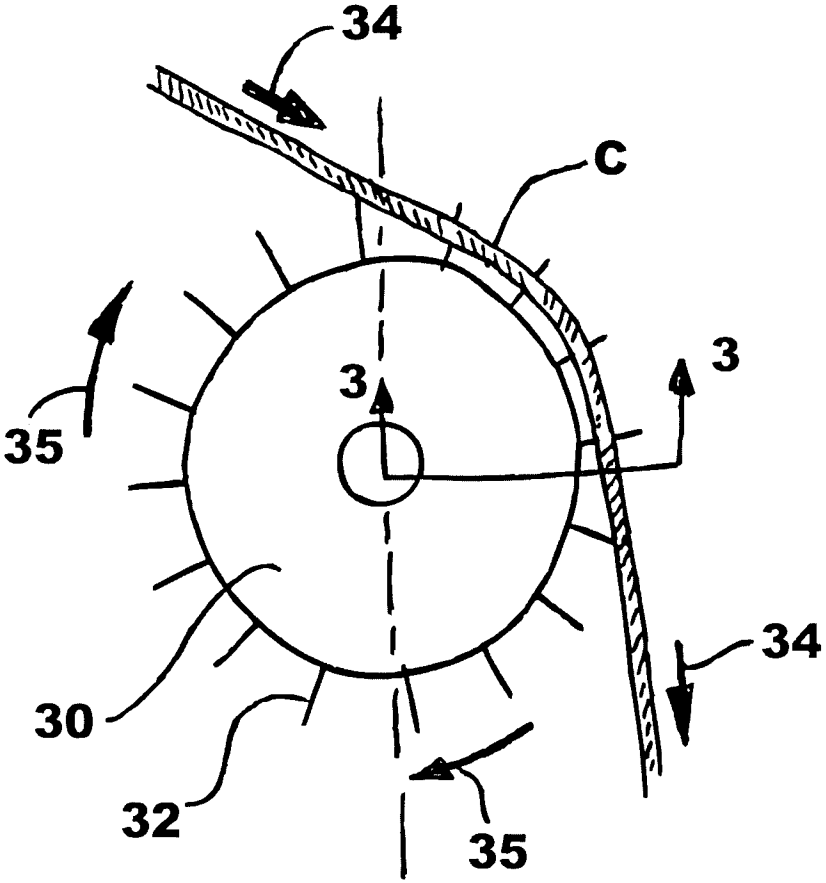
FIG. 2 (new) is an artistic perspective view of the basic mechanism of my new turn wheel. It shows the generally cylindrical housing or drum, and a cable partially wrapped around it and resting on the spokes. Although the load itself is not shown, two arrows indicate the direction of movement of a load along the cable path, and another curved arrow shows the corresponding direction of rotation of the wheel.

FIGS. 2 and 3 provide a schematic representation of the structure and operation of my turn wheel. FIG. 2 is a plan view and FIG. 3 is a partial vertical cross-section view taken on line 3-3 of FIG. 2. A drum 30 shaped somewhat like an upside down cup has a set of spokes 32 which are spaced around its circumference at its lower end and extend radially outward. As shown in FIG. 3, the spokes slope somewhat sharply down toward their outer ends. Cable C is partially wrapped around the drum 30, as shown in FIG. 2, and rests upon the inner ends of several of the spokes as shown in FIG. 3. In this schematic illustration there is no horizontal portion of the spokes—only their operative, downwardly sloped, portions.

The direction of movement of a load along the path of the cable is shown in FIG. 2 by arrows 34. In my preferred embodiment the cable is stationary and fixed, and only the load moves along the cable path. A curved arrow 35 shows the direction of rotation of the wheel in response to movement of the load, irrespective of whether the cable is fixed or is being pulled longitudinally. As the wheel rotates, the points of engagement of the cable with the spokes will move radially along the various spokes.

As shown in FIG. 3, a vertical shaft 36 is concentric to the drum 30 and supports it for rotation in a horizontal plane. Cable C is pressed tightly against the side of the drum with a radial force, indicated by an arrow 37. Dotted line 40 represents a safety rod that is placed above and generally parallel to the spoke, to prevent any inadvertent dislodgment of the cable from the spokes. The safety rod is a secondary one of the main operative parts. It is shown here as directly attached to the drum, above both the cable and the spoke 32. The cable is forced radially inward against the drum while at the same time being captured within an open jaw formed by the spoke and its safety rod.

In concept, my turn wheel includes a cylindrical central drum for supporting the spokes. In actual practice I prefer to use a bifurcated spoke assembly to form both the operative spoke arm portion and a safety rod, and at the same time to provide an open jaw between them with a cavity at the bottom for capturing the cable. Thus in the illustration of FIG. 1 the bottoms of open jaws defined by spoke arm extensions 24, 26, correspond to the outer cylindrical surface of drum or cylinder 30 in FIGS. 2 and 3.

Figure 4:
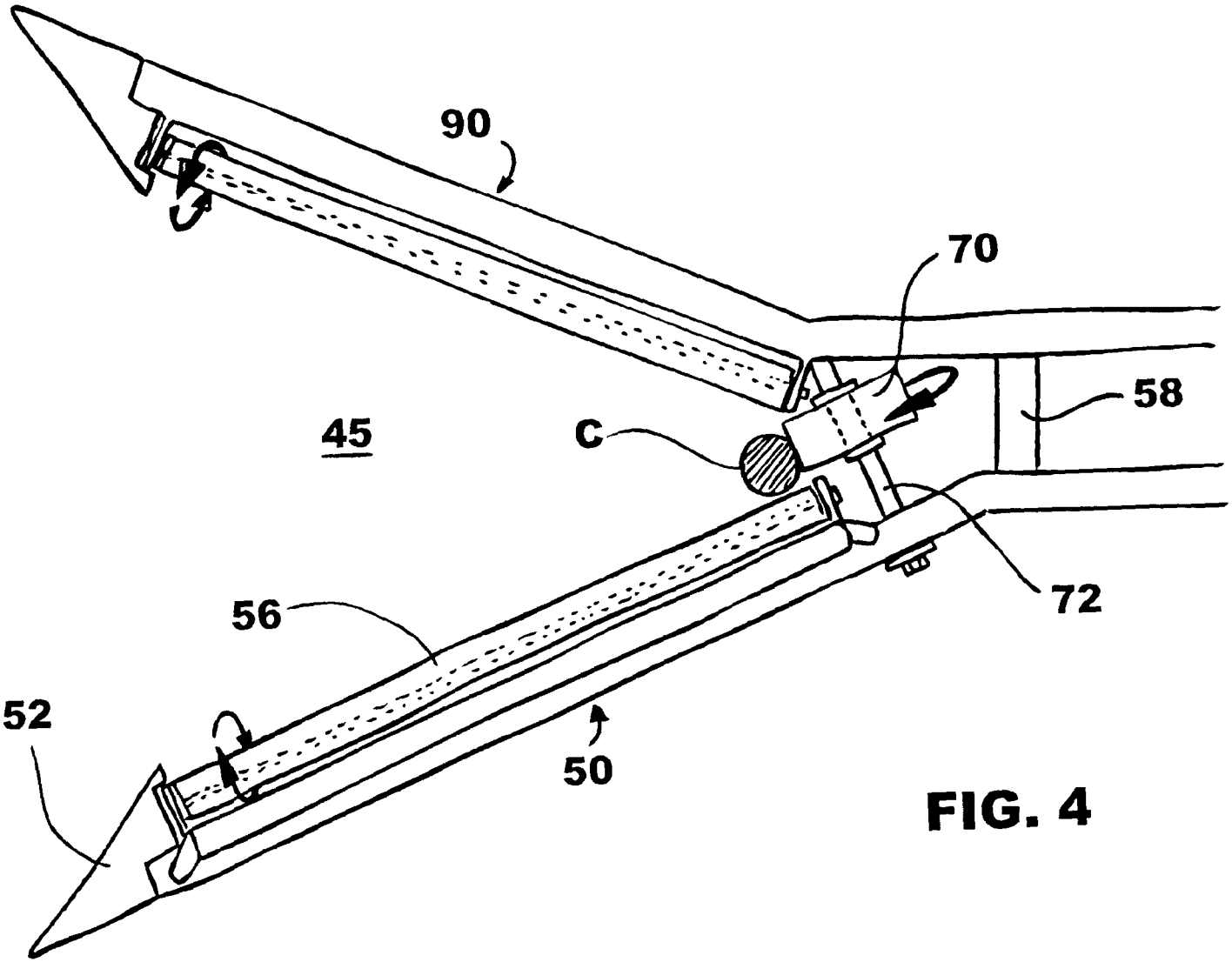
FIG. 4 is a side elevation view of the outer end portion of the presently preferred form of my spoke, including its associated safety rod, with longitudinal roller bearings on the inside surfaces of the jaw, pulley wheel at the bottom of the jaw, cable location, and push bar on the leading edge of the spoke arm.

FIG. 4 is a vertical elevation view of the outer end portion of my presently preferred spoke construction. The spoke assembly 45 has upper and lower beam portions 90, 50, which are parallel as they emanate from the center of my wheel, supported by a spacer 58. The outer ends of beam portions 50, 90, then diverge. Lower beam portion 50 slopes downwardly relative to the common axis of the beams. An elongated roller 56 extends parallel to the upper surface of beam portion 50, which is thus obscured in the FIG. 4 drawing. An enlarged outer end portion 52 of beam 50 provides a bearing housing to support roller 56 for rotation about an axis parallel to the beam 50.

Figure 5:
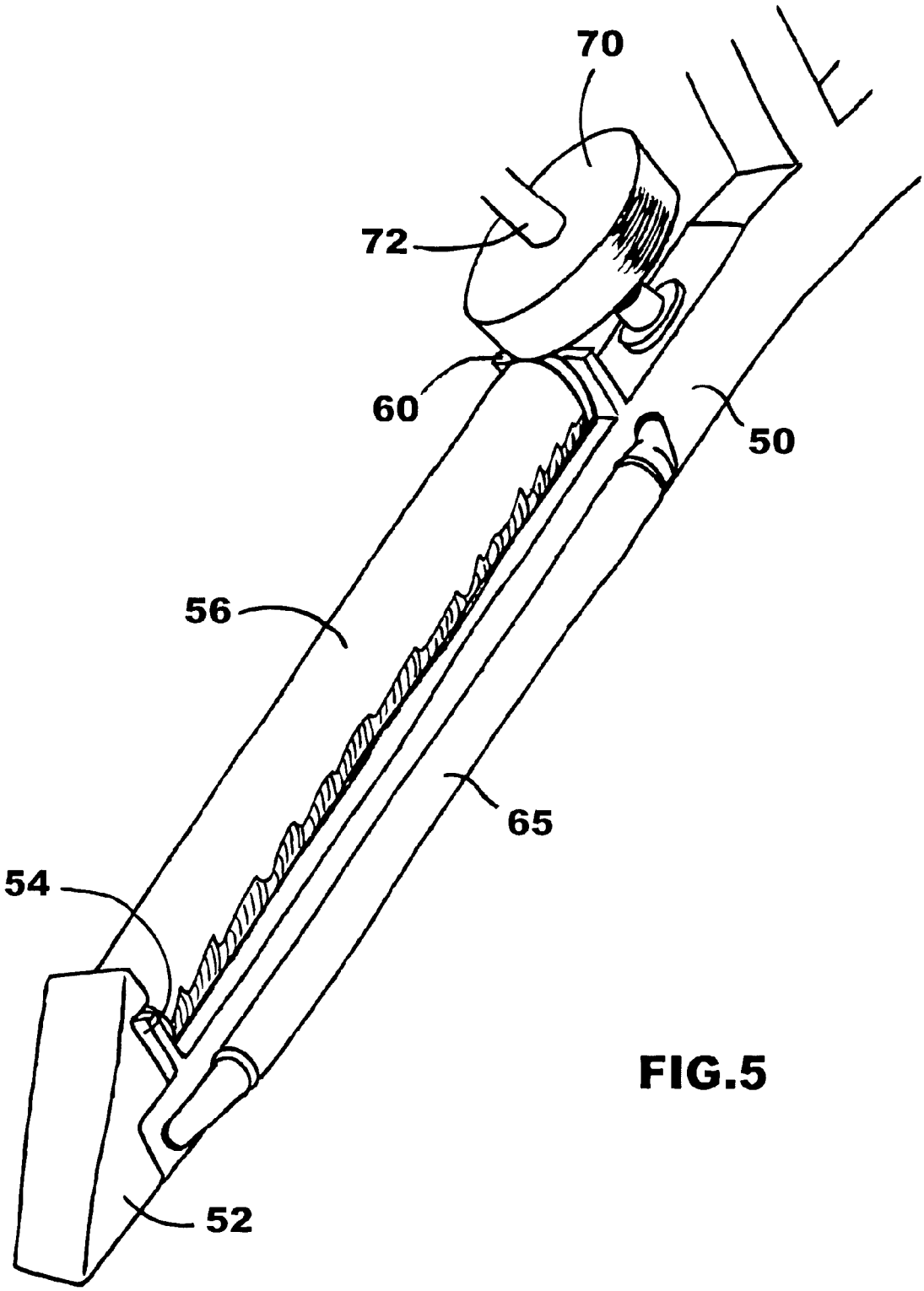
FIG. 5 is a perspective of the spoke arm with longitudinal roller, pulley wheel, and push bar.

FIGS. 4 and 5 together show actual details of my presently preferred spoke assembly. FIG. 4 is a vertical cross-sectional view of the radially outer portion of the spoke assembly. As shown there, the spoke assembly is bifurcated, having an operative spoke arm part 50 inclined downwardly and associated safety rod 90 angled upwardly. The spoke arm 50 and its associated safety rod 90 provide an open jaw into which the cable will selectively move in or out, as points of contact of the various spoke arms 50 with cable C move radially in response to the turn wheel rotation. The structure of lower spoke arm 50 is shown in more detail in FIG. 5.

Referring more specifically to FIG. 5, the lower spoke arm 50 has a ramp portion 52 on its outer end. At its upper end the ramp 52 has a housing 54 that rotatably supports bearings for one end of elongated cylindrical roller 56. Roller 56 extends parallel to and covers over the otherwise upper surface of arm 50. The upper end of roller 56 is rotatably supported in bearings in a housing 60 that is carried by the upper end portion of spoke arm 50. Beyond the housing 60 a pulley wheel 70 is mounted on a shaft 72 carried by the spoke arm for rotation in a plane parallel to the upper surface of roller 56 and also parallel to its axis of rotation. In operation, if the cable C moves in a longitudinal direction relative to the spoke assembly, its movement will be facilitated both by the roller 56 and by the pulley wheel 70. In my preferred embodiment, of course, it is the cable that remains stationary while the spoke arm rotates underneath it about the vertical axis of the wheel. If the cable is being pulled longitudinally, the functioning of the roller 56 and of the pulley wheel 70 are far less important, because longitudinal sliding motion of the cable relative to the wheel will be more limited. The roller 60 has a relatively smooth upper surface to facilitate movement of the cable C.

Thus the spoke arm 50 carries a pulley wheel or central bearing 70 whose axis of rotation is perpendicular to the upper surface of roller 56 and spoke arm 50. In the operation of the wheel it is then the full set of rollers 70 that form the functional equivalent of the surface of cylindrical drum 30 of FIGS. 2 and 3. The cable will rest on the spinning pulley 70, as shown in cross-section in FIG. 4. The spinning wheel or pulley 70 is the ultimate radially inward destination of the cable. As the wheel rotates relative to the curved cable portion, spoke ramp 52 initially slides underneath the cable and supports it from the lower arm 50.

Another feature of the spoke assembly as shown in FIGS. 4 and 5 is an elongated push bar 65, parallel to the spoke arm 50, which will be engaged by a moving trolley to then drive the wheel in rotation. Operation of the push arm in driving the wheel in rotation is illustrated in FIG. 7B.

The safety arm or rod 90 shown in FIG. 4 may be constructed in the same manner as lower spoke arm 50, but that is optional, as the safety arm 90 may not need to have the same set of roller bearings in order to do its job.

Figure 6:
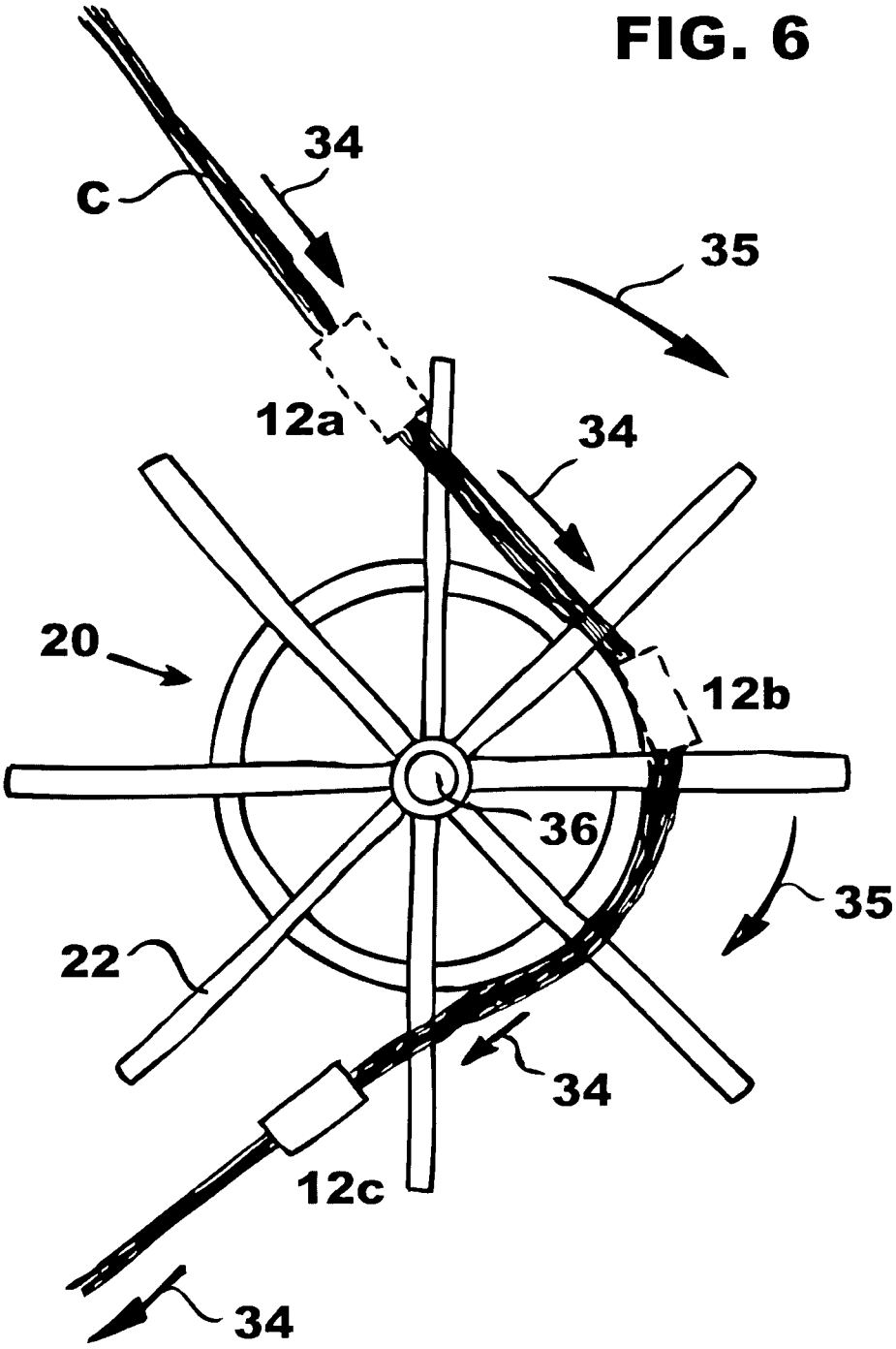
FIG. 6 is a plan view showing how the trolley passes through the wheel as the wheel rotates.

Reference is now made to FIG. 6, which is a plan view illustrating the action that takes place when a load moving along a stationary cable engages my turn wheel with preferred spoke assembly construction. The wheel is designated by numeral 10, and it rotates on a generally vertical axis 36. Spokes 22 are seen only from above. Cable C is stationary and is partially wrapped around the spokes, being retained by the bottoms of the open jaws that the spokes provide. Arrows 34 show the path of movement of the load along the cable. Curved arrows 35 show the corresponding rotation of my turn wheel. Trolley 12 is the load, its successive positions being marked as 12*a*, 12*b*, and 12*c*.

As indicated in FIG. 6, the trolley 12 will enter a space between two of the spokes 22, engage a side of one of the spokes, and thus drive the wheel in rotation. As stated in an earlier paragraph, it is advisable to provide compatible parts or surfaces on both the trolley and the spoke to ensure that the driving engagement of the trolley against a side surface of the spoke will be mechanically reliable and safe.

Figure 7A:
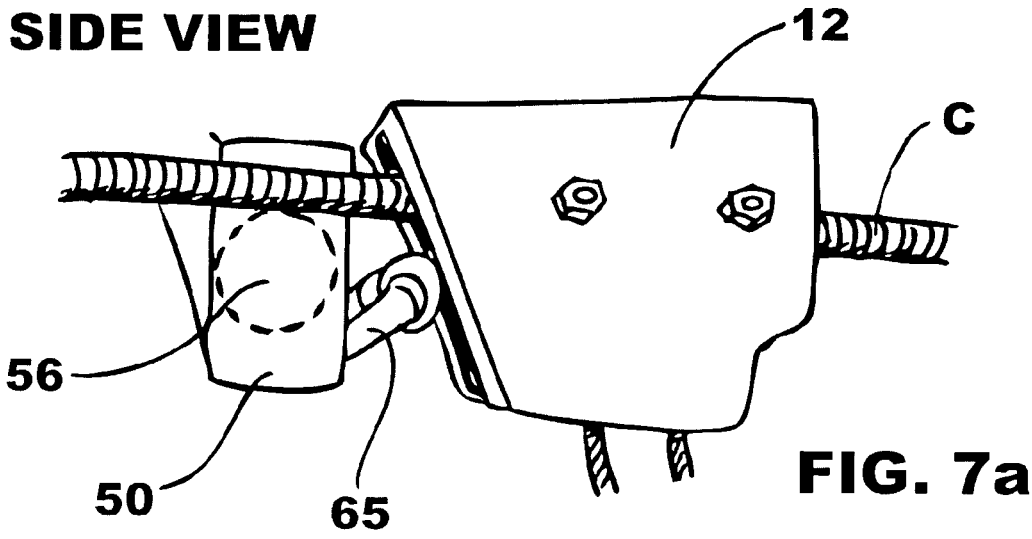
FIGS. 7A and 7B show details of the driving engagement of the trolley with a push bar.
Figure 7B:
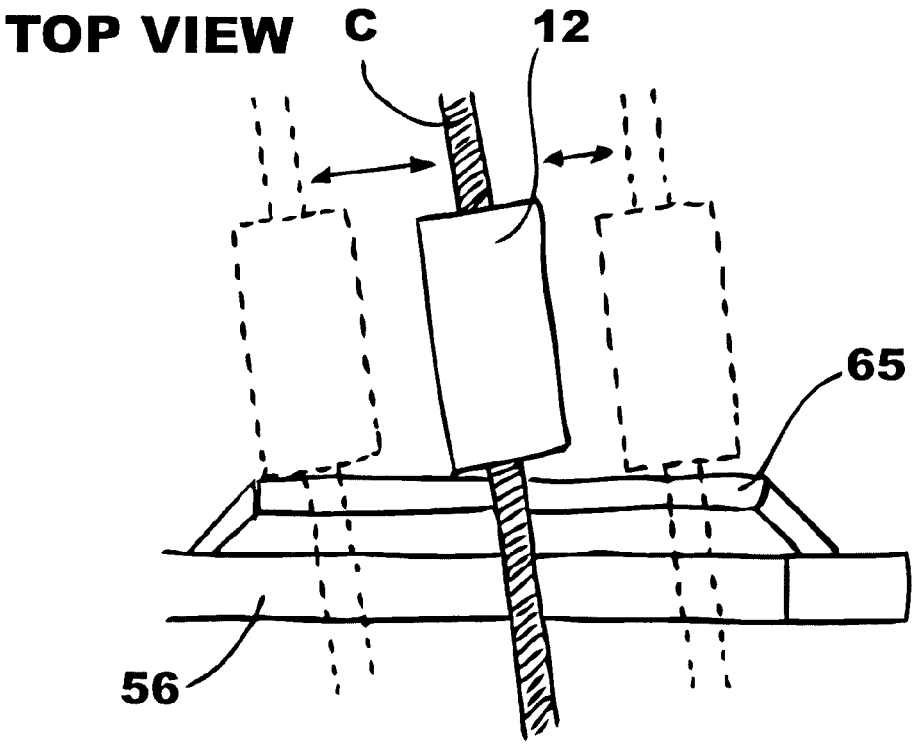

FIG. 7A is a fragmentary elevational view showing how the moving trolley 12 riding on stationary cable C engages a push bar 65 that is also carried by the lower spoke arm 50. The cable rests upon roller 56 that, as previously explained, rotates on an axis parallel to the upper surface of spoke arm 50. The trolley 12 contacts the push bar 65 but does not engage the lower roller 56. The cable rests upon the roller 56 while the trolley 12 drivingly engages the push bar 65. Push bar 65 is deliberately spaced horizontally away from the lower spoke arm 50 so that the trolley will not engage roller 56. As an alternate construction, lower spoke arm 50 could be made wider to include an integral push bar 65.

As shown in FIG. 7B, after the cable C has slid a measurable distance on the lower arm roller 56, the trolley 12 engages the push bar 65 so that its position is somewhat intermediate to the length of the roller 56 as the trolley continues to drive the turn wheel in rotation.

The main purpose of the lower diverging spoke 50 arm is to provide vertical support for the curved portion of the cable C as the turn wheel rotates but the cable continues to be fixedly supported at its two ends. The main purpose of the upper diverging arm 90 is to prevent the cable from being inadvertently lost. When the cable is sliding radially inward on the lower arm, if its motion becomes erratic, the upper arm assures the proper action to then keep the cable captured between the two arms.

Construction of the turn wheel is not difficult. Although a cylindrical central drum could be used as shown schematically in FIGS. 2 and 3, I prefer a frame with the bifurcated upper and lower spoke arms 90, 50, as shown in FIGS. 4 and 5. The wedge-shaped end 52 of lower arm 50 provides a ramp for smoothly picking up the cable C as the wheel turns. Rollers 56 and 70 enable the wheel to rotate effortlessly in response to the driving movement of the trolley. Details shown in FIG. 7A are important. It is most advisable to prevent the trolley from engaging roller 56, as the free bearing support action for the trolley could be compromised.

FIG. 1 illustrates an application where several of my turn wheels are used in a single zipline course. With the cable itself being fixed and stationary, the different sections of the course can have differing slopes and hence will provide different travel speeds for the sportsters. This is a function that cannot be achieved with previously known technology. Short spans can be used, keeping the traveler at all times a safe distance above ground. The vertical supports for the various turn wheels can be constructed on safe ground locations and without the need to damage or deface trees.

Reference Number Listings

FIG. 1: cable 10; trolleys 12, 14; sportsters 13, 15; wheel 20; spokes 22, 24, 26 FIGS. 2 and 3, schematic: cable C; drum or frame 30; spokes 32; vertical shaft 36; safety rod 40; arrow 34 load movement; arrow 35 wheel movement; arrow 37 radial force FIGS. 4, 5: 45 spoke assembly; 50 lower beam spoke arm; 52 ramp; 54 bearing housing; 56 roller; 60 bearing housing; 65 push bar; 70 pulley wheel; 72 pulley shaft; 90 upper beam of spoke assembly FIG. 6: cable C; 20 wheel; 36 vertical axis; 22 spokes; arrow 34 load movement; arrow 35 wheel movement FIGS. 7A, 7B: C cable; 65 push bar; 12 trolley My invention has been disclosed in considerable detail in order to comply with the patent laws. It should be understood, however, that the scope of the invention is to be adjudged only in accordance with the appended claims.

The invention claimed is:

1. In a cable transport system for supporting a cable through a partially curved path, a turn wheel comprising:

a generally cylindrical inner frame having a central hub, and means for supporting both the hub and the frame for rotation about a vertical axis, a plurality of spoke assemblies spaced circumferentially about the inner frame and extending radially outwardly therefrom, each spoke assembly having a lower spoke arm that has a downwardly sloped upper surface; and an elongated cylindrical roller supported in parallel relation to the sloped upper surface of each respectively corresponding lower spoke arm and supported from the spoke arm for rotation about the longitudinal axis of the roller;

so that when an associated cable is supported on one or more of the lower spoke arms and the turn wheel is driven in rotation relative to the cable, the lower spoke arms are then free to move longitudinally relative to the cable while at the same time the cable may slide along the spoke arm rollers in a direction radial to the frame.

2. A turn wheel as in claim 1 wherein each lower spoke arm has an outer end with a ramp portion to facilitate a supporting engagement underneath a cable.

3. A turn wheel as in claim 1 wherein each spoke also has an upper spoke arm, and the turn wheel also includes a pulley wheel on the central hub between the upper and lower spoke arms, and mounted for rotation about an axis perpendicular to the common plane of the spoke arms.

4. A cable transport system comprising:

a stationary cable under longitudinal tension;

turn wheel having a frame supported in a horizontal plane for rotation about a vertical axis, with a plurality of circumferentially spaced and radially extending spoke assemblies, each spoke assembly having an inner end and being bifurcated at its outer end to provide upper and lower spoke arms, each lower spoke arm having an upper surface that slopes downwardly toward the outer end of the lower spoke arm, the outer end of each spoke arm having a ramp to facilitate its engagement with the under surface of the cable when the turn wheel is driven inrotation relative to the cable;

the stationary cable being partially curved in an essentially horizontal plane and resting upon and supported by at least two of the spoke arms;

wherein each lower spoke arm also has a longitudinal roller extending parallel to its upper surface for the cable to enter upon from the ramp, the lower end of the roller being rotationally supported from the ramp, and a pulley wheel mounted within the inner ends of alt of the spoke arms for rotation about the vertical axis of the frame so as to limit travel of the cable in a direction radially inward of the turn wheel when the turn wheel is driven in rotation relative to the cable.

* * * * *